United States Patent [19]

Howard

[11] Patent Number: 4,472,900

[45] Date of Patent: Sep. 25, 1984

[54] TELESCOPING MAGAZINE

[76] Inventor: William J. Howard, P.O. Box 573, Wilson, N.C. 27893

[21] Appl. No.: 452,400

[22] Filed: Dec. 22, 1982

[51] Int. Cl.[3] ..... F41C 25/02

[52] U.S. Cl. ..... 42/50

[58] Field of Search ..... 42/50, 7

[56] References Cited

U.S. PATENT DOCUMENTS

| | | | |
|---|---|---|---|
| 1,044,983 | 11/1912 | Brown | 42/50 |
| 3,440,751 | 4/1969 | Fremont | 42/50 |
| 3,443,334 | 5/1969 | Ardolino | 42/50 |
| 3,453,762 | 7/1979 | Fremont | 42/50 |
| 3,603,020 | 9/1971 | Wiese | 42/50 |
| 3,619,929 | 11/1971 | Fremont | 42/50 |
| 3,726,038 | 4/1973 | Bredbury | 42/50 |
| 3,964,199 | 6/1976 | Musgrave | 42/50 |
| 4,139,959 | 2/1979 | Howard et al. | 42/50 |

FOREIGN PATENT DOCUMENTS

| | | | |
|---|---|---|---|
| 747658 | 10/1944 | Fed. Rep. of Germany | 42/50 |

*Primary Examiner*—Charles T. Jordan

*Attorney, Agent, or Firm*—Quaintance & Murphy

[57] ABSTRACT

A telescoping magazine for holding and feeding cartridges to a firearm. The magazine has a fixed portion which itself comprises a firearm-engaging section and a skirt. The firearm-engaging section and the skirt are each provided with a plurality of ribs for holding two parallel offset rows of cartridges. A slide slides within the skirt and comprises slots adapted to receive ribs of the skirt. The magazine also has a follower biased by a spring.

14 Claims, 8 Drawing Figures

TELESCOPING MAGAZINE

Telescoping magazines for holding and feeding cartridges to a firearm are well known. The telescoping magazines generally comprise a container for two parallel offset rows of cartridges. The lowermost cartridge rests on a follower which is urged toward the firearm by a spring. Many attempts have been made to provide magazines that can be stored loaded with cartridges. See, for example, Ardolino, U.S. Pat. No. 3,443,334. However, such prior attempts suffer from a number of disadvantages. One disadvantage is that the spring weakens in storage. This weakening of the spring causes subsequent unreliable feeding of the cartridges from the magazine to the firearm. To overcome this disadvantage, modification in the structure and form of springs has been suggested. See Musgrave, U.S. Pat. No. 3,964,199. However, the springs of Musgrave are expensive and ineffective. They are ineffective because it requires as much as fifteen pounds of pressure to compress the spring. It is difficult or impossible to apply this pressure with the human hand alone.

Another problem in prior telescoping magazines is the tendency of the spring to depart from a straight line. This departure from a straight line is sometimes referred to as "snaking". Snaking of the spring causes uneven pressure on the cartridges and results in unreliable feeding of the cartridges from the magazine to the firearm.

Another problem is that prior magazines in general contain only twenty or at most twenty-five cartridges.

Accordingly, it is an object of the present invention to provide an improved telescoping magazine substantially free of one or more of the disadvantages of prior telescoping magazines.

Another object is to provide a telescoping magazine wherein the spring does not weaken on storage even when the magazine is stored with cartridges loaded in the magazine.

Another object is to provide a telescoping magazine which can employ an inexpensive coil spring.

Still another object of the present invention is to provide an improved telescoping magazine which requires far less than fifteen pounds of pressure to load cartridges into the magazine.

Still another object of the present invention is to provide an improved telescoping magazine free of spring snaking.

Still another object of the present invention is to provide an improved telescoping magazine capable of holding and reliably feeding forty-five cartridges.

Figure 1:
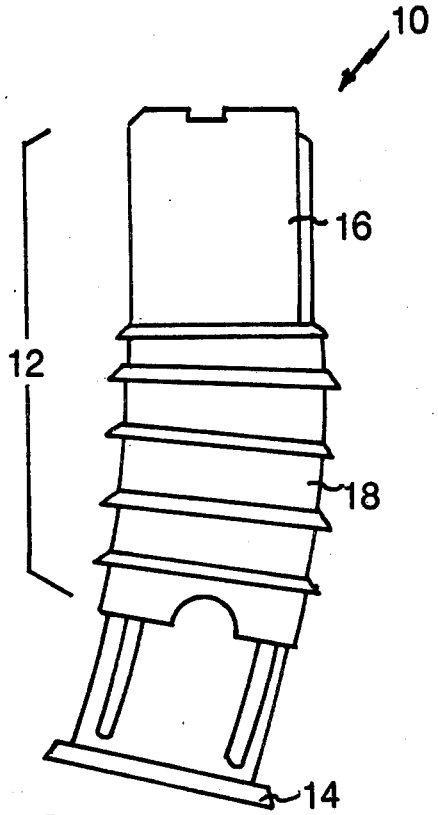
Figure 2:
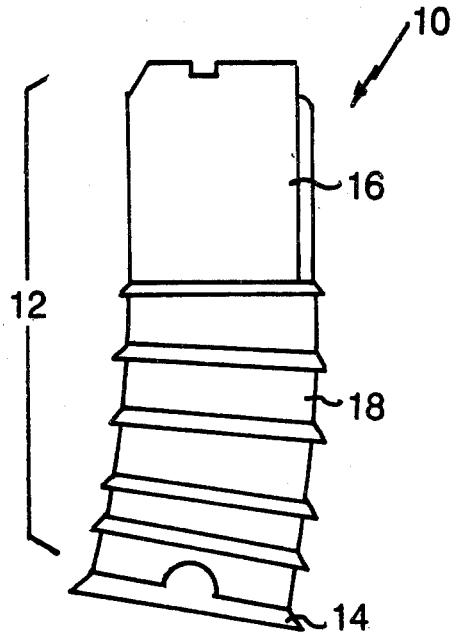
Figure 8:
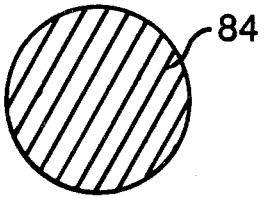
Figure 3:
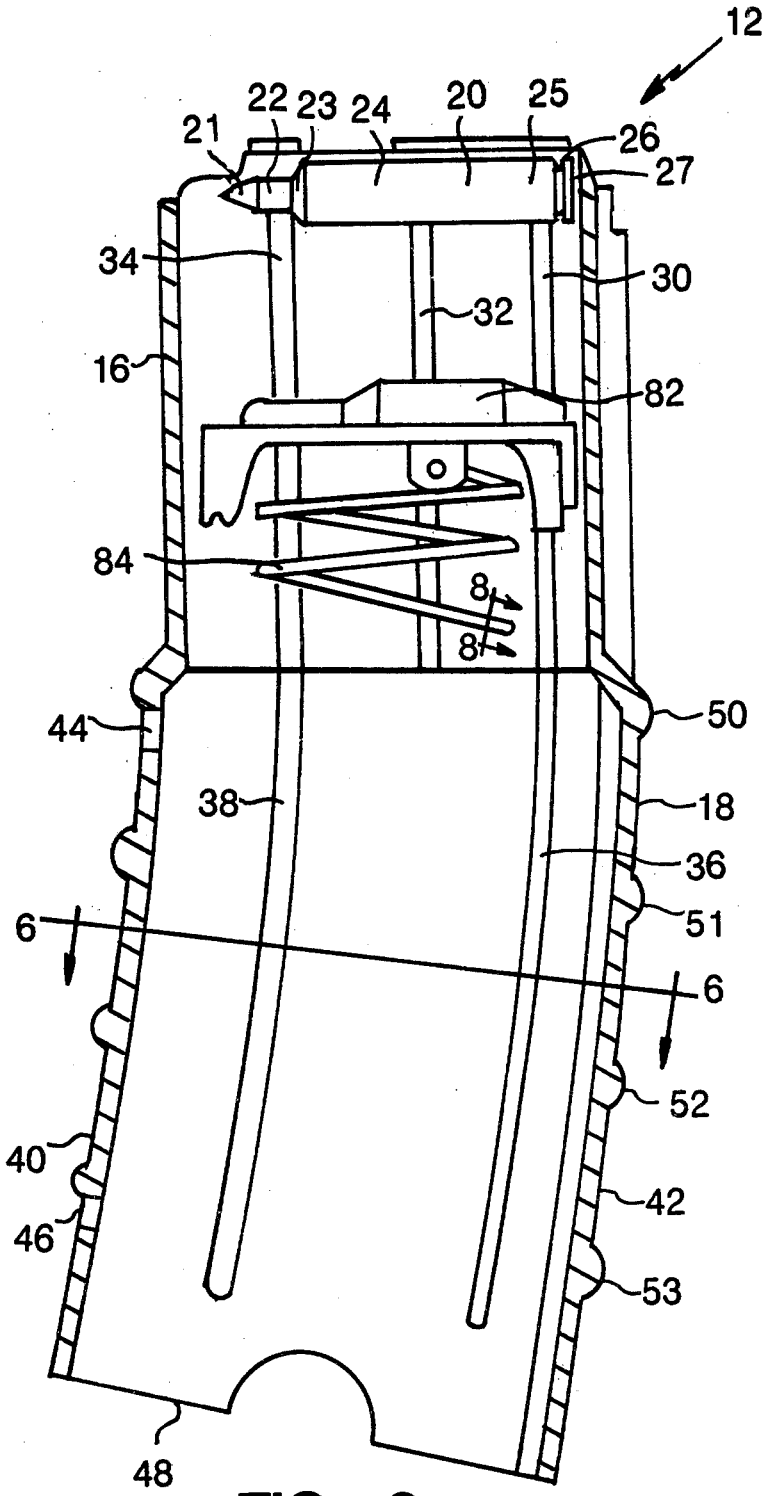
Figure 4:
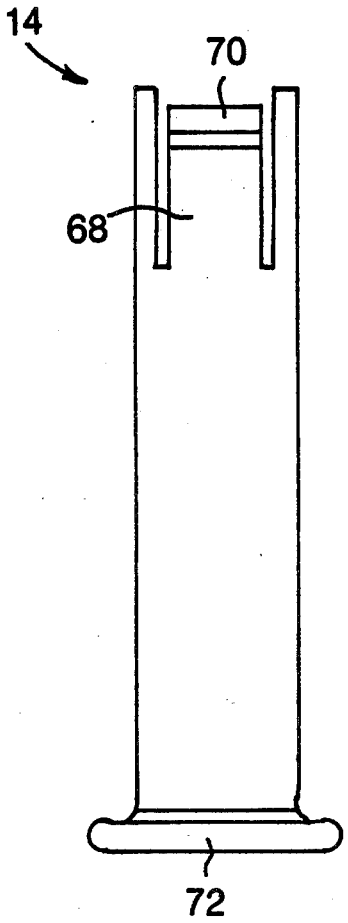
Figure 5:
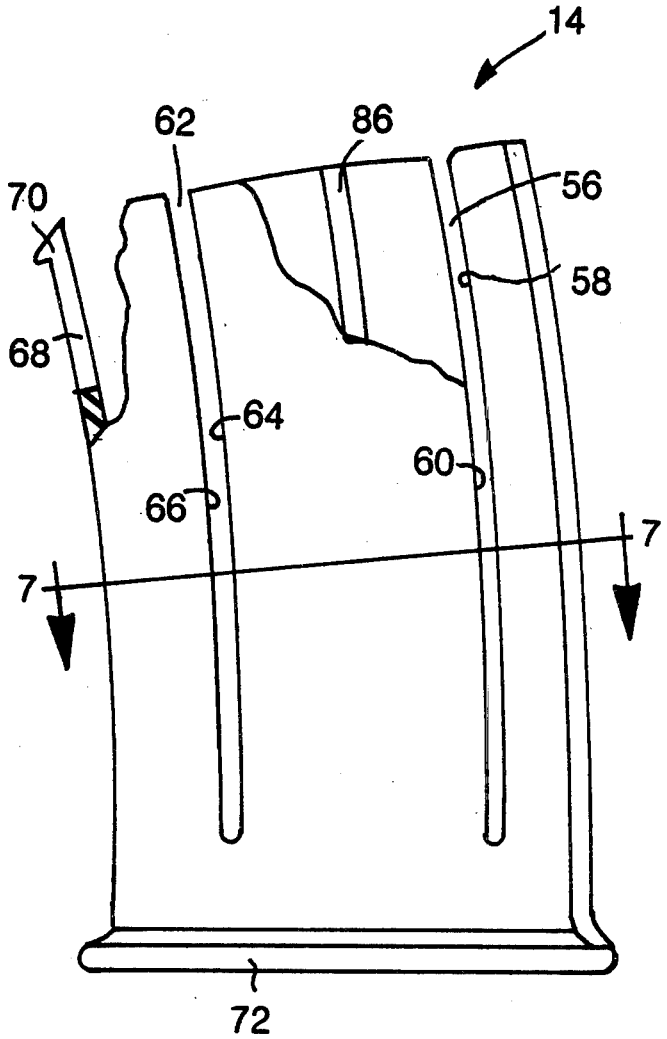
Figure 6:
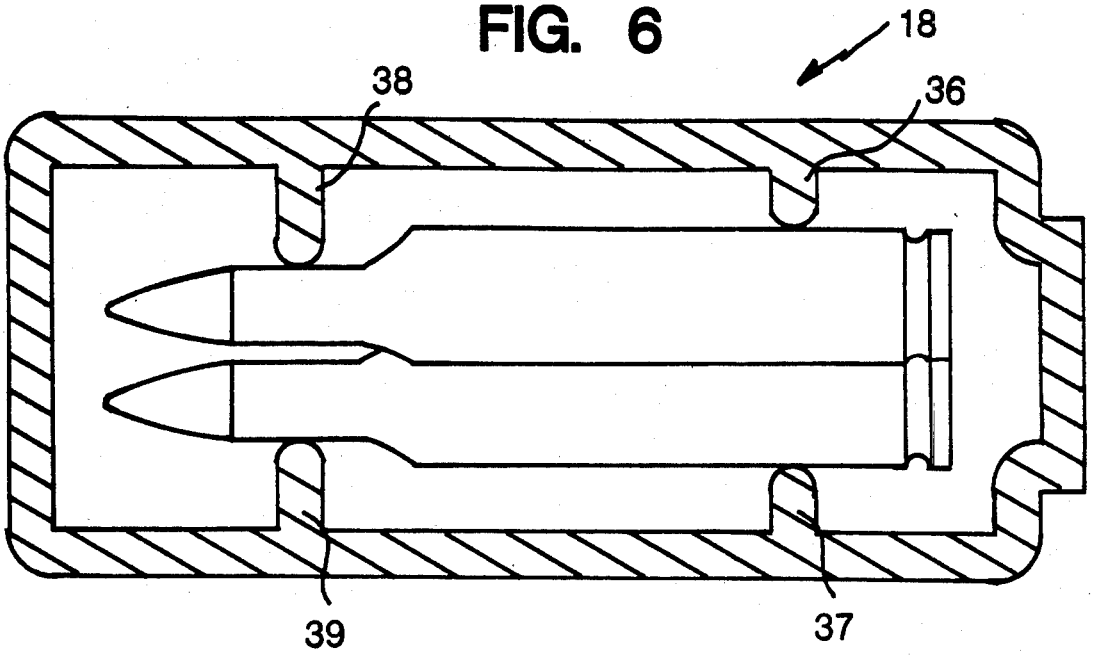
Figure 7:
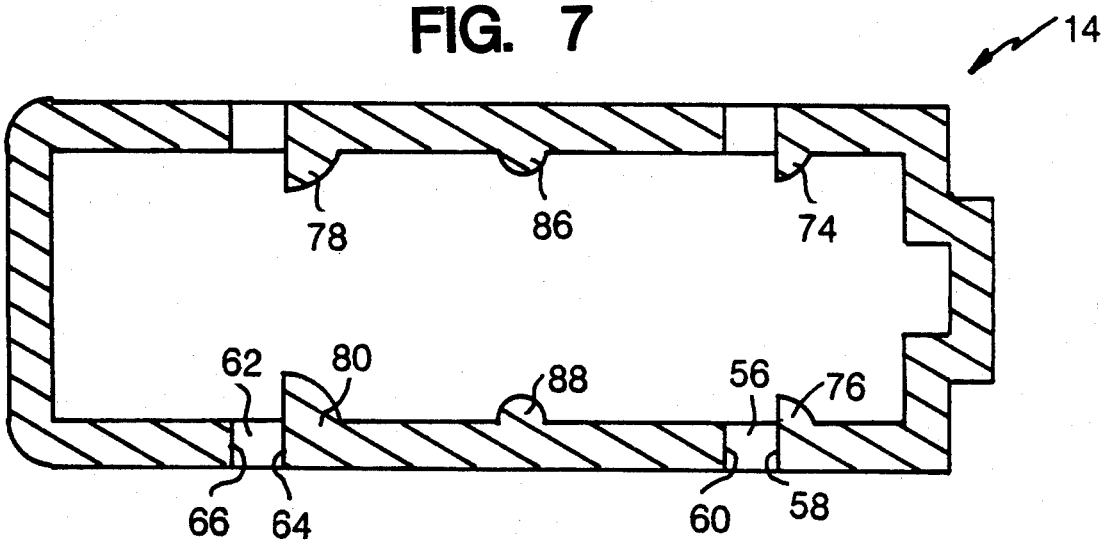

Additional objects and advantages of the present invention will be apparent to those of ordinary skill in the art by reference to the following detailed description and drawings wherein:

FIG. 1 is a side view of a telescoping magazine of the present invention with its slide extended; and FIG. 2 is a side view of a telescoping magazine of the present invention with its slide in the uppermost position; and FIG. 3 is a sectional view of the fixed portion of a telescoping magazine of the present invention; and FIG. 4 is an end view of a slide to be used with the telescoping magazine of the present invention; and FIG. 5 is a side view of the slide of FIG. 4; and FIG. 6 is an enlarged sectional view taken along Line 6—6 of FIG. 3; and FIG. 7 is a sectional view taken along Line 7–7 of FIG. 5; and FIG. 8 is a sectional view of the spring useful in the present invention which sectional view is taken along Line 8—8 of FIG. 3.

Referring now to the drawings in general and in particular to FIG. 1, there is shown a telescoping magazine 10 comprising a fixed portion 12 and a slide 14. The fixed portion 12 comprises a firearm-engaging section 16 attached to a skirt 18.

Referring now to FIG. 3, there is shown a cutaway view of the fixed portion 12 comprising its firearm-engaging section 16 and its skirt 18. Within the fixed portion 12 is shown a single representative cartridge 20. The cartridge 20 comprises a projectile 21 crimped into a neck 22. The neck 22 is connected to a shoulder 23 which, in turn, is connected to the body 24. The body 24 terminates in a base 25 having an extractor recess 26 and a rim 27. The cartridges, such as the representative cartridge 20, are stacked in the magazine in two parallel offset rows (see FIG. 6. See FIG. 4 of Ardolino.). The two rows are parallel to each other because the planes defined by the center lines of the respective cartridges are parallel. The two rows are offset because the cartridges in one row seek to rest in the space between adjacent cartridges of the adjacent row.

The firearm-engaging section 16 is provided with three pairs of ribs, only one rib of each pair being visible in FIG. 3. The rear pair of ribs, of which the rib 30 is one, contacts the adjacent row of cartridges on the body 24 of the cartridge 20 near its base 25. The intermediate pair of ribs, such as the rib 32, contacts the adjacent row of cartridges, such as the cartridge 20, on the body 24 of the cartridge 20 midway between the base 25 and the neck 22. The front pair of ribs, such as the rib 34, contacts the adjacent row of cartridges, such as the cartridge 20, on the neck 22 of each cartridge.

The firearm-engaging section 16 of the fixed portion 12 of the magazine 10 is fixedly attached to a skirt 18. The skirt 18 has a rear pair of ribs, such as the rib 36, the rib 36 is substantially colinear with the rib 30. The pair of ribs 36,37 (see FIG. 6) contact the parallel offset row of cartridges on the body of each cartridge in the adjacent row in a manner similar to the function performed by the rib 30.

The skirt 18 is also equipped with a front pair of ribs 38,39 (see FIG. 6). The front pair of ribs 38,39 contact the parallel offset row of cartridges on the neck of each cartridge in the adjacent row in a manner similar to the ribs, such as the rib 34. The rib 38 is substantially colinear with the rib 34. The front wall 40 and the rear wall 42 are curved, such that adjacent cartridges are in contact with one another throughout the length of their bodies. The skirt 18 is provided with an upper lug-receiving hole 44 and a lower lug-receiving hole 46, the purpose and function of which is more completely described below. The lug-receiving hole 46 is near the lower extremity 48 of the skirt 18. The external surface of the skirt 18 is equipped with a plurality of circumferential bands, such as the bands 50,51,52,53. The bands 50,51,52,53 provide reinforcement for the skirt 18 and also provide a slip-resistant hand grip.

Referring now to FIGS. 4 and 5, there is shown the slide 14 useful in the magazine 10 of the present invention. The slide 14 is provided with a pair of rear slots, such as the slot 56, defined by parallel juxtaposed walls 58,60. The slot 56 has a width slightly greater than the rib 37 (see FIG. 6) and is adapted to slidingly receive the rib 37.

The slide 14 is also equipped with a pair of front slots, such as the slot 62. The slot 62 is defined by the walls 64,66. The width of the slot 62 is slightly larger than the width of the rib 39 (see FIG. 6) and is adapted to slidingly receive the rib 39.

The slide 14 is also equipped with a tongue 68 terminating in a lug 70. The lug 70 is adapted to fit into the lug-receiving holes 44,46 in the skirt 18 (see FIG. 3). The tongue 68 is outwardly biased to cause the lug 70 to engage either the hole 46 or the hole 44. When the lug 70 is engaged in the hole 46, the spring 84 is prevented from forcing the slide 14 from the skirt 18. Maximum compression of the spring 84 is provided by engaging the lug 70 in the hole 44. The slide 14 is also fitted with a spring-resisting bottom 72.

Referring now to FIG. 7, it can be seen that the slide 14 is equipped with a rear pair of ribs 74,76. The distance between the ribs 74,76 is equal to the distance between the ribs 36,37 of the skirt 18 (see FIG. 6). The slide 14 is also equipped with a front pair of ribs 78,80. The rib 80 is adjacent to the front slot 62. The distance between the ribs 78,80 is substantially equal to the distance between the ribs 38,39 (see FIG. 6).

Additionally, the slide 14 is equipped with an intermediate pair of ribs 86,88. This intermediate pair of ribs 86,88 contacts the adjacent row of cartridges, such as cartridge 20, on the body 24 of the cartridge 20 midway between the base 25 and the neck 22.

A rectangular coil spring (not shown in any of FIGS. 4, 5, 6, or 7) rests on the bottom 72 of the slide 14 and extends within the slide 14 between the ribs 74,76 and between the ribs 78,80 and is connected on its lower end to a follower 82 (see FIG. 3). Preferred structure for the follower is shown in Howard et al, U.S. Pat. No. 4,139,959. The structure of the follower there shown is ideally suited for the follower 82 of the present invention. The follower 82 is urged toward the cartridge 20 by the spring 84. The follower 82 is adapted to receive upward pressure from below caused by the spring 84. The spring 84 rests on the bottom 72 of the slide 14 and biases the follower 82 toward the cartridge 20 and the firearm (not shown). In the magazine 10 of the present invention, the spring 84 is prevented from snaking by contact of the spring 84 with the ribs 30, 32, 34, 36, 37, 38, 39, 74, 76, 78 and 80.

The telescoping magazine 10 of the present invention can be constructed of metal, plastic, or other material, but is preferably constructed of plastic. A wide variety of plastics can be employed if they have the proper physical properties of strength, resilience, and toughness. Plastics such as polyesters, polyamides and polyolefins are potential candidates. The preferred material is a fiber-filled nylon sold by the Dupont Chemical Company under the tradename ZYTEL. In a preferred embodiment of the present invention, the fixed portion 12 comprising the firearm engaging portion 16 and the skirt 18 are formed from a single, injection-molded piece of thermoplastic.

To assemble the telescoping magazine 10 of the present invention, the spring 84 is attached to the follower 82 whereupon the spring 84 and the follower 82 are placed within the fixed portion 12 of the magazine 10 as shown in FIG. 3. The slide 14 is inserted into the bottom of the skirt 18 until the lug 70 catches on the hole 46 whereupon the magazine 10 has the appearance shown in FIG. 1. To disassemble the magazine 10, the lug 70 is forced from the hole 46 whereupon pressure exerted by the spring 84 on the bottom 72 of the slide 14 causes the slide 14 to be pushed from the skirt 18.

Magazine 10 of the present invention is loaded in a conventional manner by serially forcing cartridges, such as the cartridge 20, into the top of the firearm-engaging section 16. The first cartridge contacts the follower 82 whereupon subsequent cartridges align themselves in two parallel offset rows as is well known in the art. The telescoping magazine 10 of the present invention can be loaded with as many as thirty cartridges and stored for indefinite periods of time without weakening the spring 84 as long as the slide 14 is extended as shown in FIG. 1. When the magazine 10 contains less than about thirty cartridges, the slide 14 can be pushed fully in as shown in FIG. 2. In this configuration, the lug 70 seats itself in the hole 44 maintaining compression on the spring 84. The telescoping magazine 10 of the present invention can be employed in the configuration shown in FIG. 2 if the marksman is carrying the firearm in confined locations, if the spring 84 is weak or for any other reason. On the other hand, the magazine 10 of the present invention, with the slide 14 extended as shown in FIG. 1, can hold as many as forty-five cartridges and will feed them rapidly and reliably to the firearm.

Although the invention has been described in considerable detail with reference to a preferred embodiment thereof, it will be apparent to those skilled in the art that the present invention can be modified without departing from the spirit and scope of the invention as described above and as defined in the appended claims.

I claim:

1. A telescoping magazine for holding and feeding cartridges to a firearm; said magazine comprising:

A. a fixed portion for attaching the magazine to the firearm; said fixed portion comprising:
   (1) a firearm engaging section having a plurality of ribs for holding two parallel offset rows of cartridges; and
   (2) a skirt fixedly attached to the firearm engaging section; said skirt having a plurality of ribs for holding the two parallel offset rows of cartridges; and B. a slide, slidably mounted in the skirt; said slide comprising:
   (1) a plurality of slots each adapted to receive one of the ribs of the skirt; and
   (2) a spring-resisting bottom; and C. a follower within the magazine for urging cartridges toward the firearm; and D. a spring resting on the bottom of the slide and biasing the follower toward the firearm.

2. The magazine of claim 1 wherein the skirt is equipped with a pair of front ribs and a pair of rear ribs; wherein the front pair of ribs contact the parallel offset rows of cartridges just forward of the shoulder of each cartridge in the adjacent row; and wherein the rear pair of ribs contact the parallel offset rows of cartridges on the body of each cartridge in the adjacent row.

3. The magazine of claim 1 wherein the slide is equipped with a tongue terminating in a lug adapted to fit into a lower hole in the skirt thus preventing the spring from forcing the slide from the skirt.

4. The magazine of claim 1 wherein the slide is equipped with a tongue terminating in a lug adapted to fit into an upper hole in the skirt in order to provide maximum compression of the spring.

5. The magazine of claim 1 having a length sufficient to hold thirty cartridges with the slide pushed in.

6. The magazine of claim 1 having a length sufficient to hold forty-five cartridges with the slide extended.

7. The magazine of claim 1 wherein the spring is a coil spring wherein the coil is rectangular in form.

8. The magazine of claim 1 wherein the spring is made of wire having a circular cross-section.

9. The magazine of claim 1 wherein the spring contacts the ribs of the skirt and is prevented from snaking by contact therewith.

10. The magazine of claim 1 wherein the external surface of the skirt is equipped with a plurality of circumferential bands which provide reinforcement for the skirt and also provide a slip-resistant hand grip.

11. The magazine of claim 1 wherein the skirt and slide are curved such that adjacent cartridges are in contact with one another throughout the length of their bases.

12. The magazine of claim 1 wherein the fixed portion, the slide and the follower are all constructed of thermoplastic.

13. The magazine of claim 1 wherein the fixed portion comprising the firearm engaging portion and the skirt are formed from a single, injection-molded piece of thermoplastic.

14. A telescoping magazine for holding and for serially feeding forty-five cartridges to a firearm wherein the cartridges comprise a projectile fitted into a neck mounted on a shoulder connected to a body which terminates in a base; said magazine comprising:

A. a fixed portion for attaching the magazine to the firearm; said fixed portion comprising:

(1) a firearm-engaging section having three pairs of ribs which function as guides for two parallel offset rows of cartridges; and wherein the rear pair of ribs contact the adjacent row of cartridges on the body of each cartridge near its base; and wherein the intermediate pair of ribs contact the adjacent row of cartridges on the body of each cartridge midway between the base and the neck of that cartridge; and wherein the front pair of ribs contact the adjacent row of cartridges on the neck of each cartridge; and (2) a skirt fixedly attached to the firearm-engaging section; said skirt having a rear pair of ribs and a front pair of ribs for holding the two parallel offset rows of cartridges in alignment;

wherein the rear pair of ribs of the skirt is substantially colinear with the rear pair of ribs of the firearm-engaging section; and wherein the rear pair of ribs of the skirt contact the parallel offset rows of cartridges on the body of each cartridge in the adjacent row; and wherein the front pair of ribs is subtantially colinear with the front pair of ribs of the firearm-engaging section; and wherein the front pair of ribs of the skirt contact the parallel offset row of cartridges on the neck of each cartridge in the adjacent row; and wherein the skirt is curved such that adjacent cartridges are in contact with one another throughout the length of their bodies; and wherein the skirt has a lug-receiving hole near its lowest extremity; and wherein the fixed portion comprising the firearm engaging portion and the skirt are formed from a single piece; and wherein the external surface of the skirt is equipped with a plurality of circumferential bands which provide reinforcement for the skirt and also provide a slip-resistant hand grip; and B. a slide, slidably mounted in the skirt, said slide comprising:

(1) a pair of rear slots adapted to slidingly receive the rear ribs of the skirt; and (2) a pair of front slots adapted to slidingly receive the front ribs of the skirt; and (3) a rear pair of ribs adjacent the rear slot; wherein the distance between these ribs is equal to the distance between the rear ribs of the skirt; and (4) a front pair of ribs adjacent the front slot; wherein the distance between these ribs is equal to the distance between the front ribs of the skirt; and (5) an intermediate pair of ribs, located midway between the front ribs and the rear ribs; wherein the intermediate ribs contact the adjacent row of cartridges on the body of each cartridge midway between the base and the neck of that cartridge; and (6) a tongue terminating in a lug adapted to fit into the lug-receiving hole of the skirt thus preventing the spring from forcing the slide from the skirt; and (7) a spring-resisting bottom; and wherein the slide is curved such that adjacent cartridges are in contact with one another throughout the length of their bodies; and C. a follower within the magazine for urging cartridges toward the firearm, said follower adapted to receive upward pressure from below; and D. a spring resting on the bottom of the slide and biasing the follower toward the firearm;

wherein the spring is a coil spring wherein the coil is rectangular in form; and wherein the spring is made of wire having a circular cross-section; and wherein the spring is prevented from snaking by contact of the spring with the ribs of the skirt; and with the ribs of the firearm-engaging section.

* * * * *